United States Patent [19]

Noda et al.

[11] 4,290,690

[45] Sep. 22, 1981

[54] DEVICE FOR CONTROLLING POTENTIAL OF LATENT IMAGE FOR USE IN ELECTROPHOTOGRAPHIC APPARATUS

[75] Inventors: Nobutaka Noda, Kawasaki; Kazuo Hamamura, Yokohama; Yoichi Morita, Ageo, all of Japan

[73] Assignee: Kabushiki-Kaisha K I P, Tokyo, Japan

[21] Appl. No.: 972,269

[22] Filed: Dec. 22, 1978

Related U.S. Application Data

[62] Division of Ser. No. 859,859, Dec. 12, 1977, abandoned.

[30] Foreign Application Priority Data

Dec. 27, 1976 [JP] Japan ..... 51-156250

[51] Int. Cl.[3] ..... G03G 15/00

[52] U.S. Cl. ..... 355/3 R; 355/69; 355/71

[58] Field of Search ..... 355/3 R, 69, 71; 96/1 R; 430/31

[56] References Cited

U.S. PATENT DOCUMENTS

| | | | |
|---|---|---|---|
| 3,655,369 | 4/1972 | Kinoshita | 96/1 R |
| 3,677,751 | 7/1972 | Ohta et al. | 96/1 R |
| 3,749,488 | 7/1973 | DeLorme | 355/69 X |
| 3,781,108 | 12/1973 | Ogawa et al. | 96/1 R |
| 3,832,169 | 8/1974 | Kinoshita et al. | 96/1 R |
| 4,052,206 | 10/1977 | Anzai | 96/1 R |
| 4,063,945 | 12/1977 | Von Hoene et al. | 96/1 R |
| 4,080,057 | 3/1978 | Nakane et al. | 355/71 X |

*Primary Examiner*—Richard L. Moses
*Attorney, Agent, or Firm*—Martin Novack

[57] ABSTRACT

A method and apparatus of electrophotography wherein before exposure of a photosensitive element to a light image the element is subjected to a substantially uniform light irradiation to release a part of the charge carriers trapped in a photoconductive layer of the element, thereby controlling the potential of a latent image to be formed on the element within a range fit for the development of the latent image.

11 Claims, 8 Drawing Figures

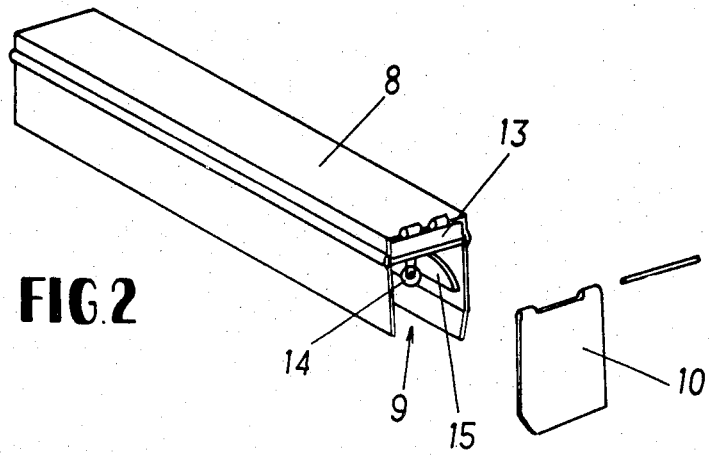
FIG. 2
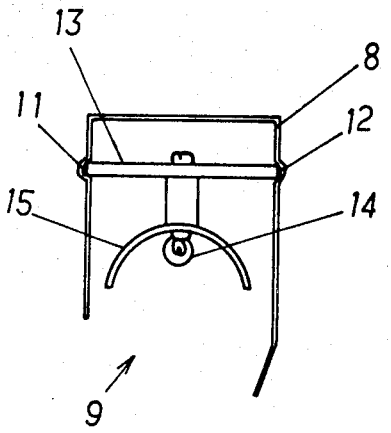
FIG. 3
FIG. 4
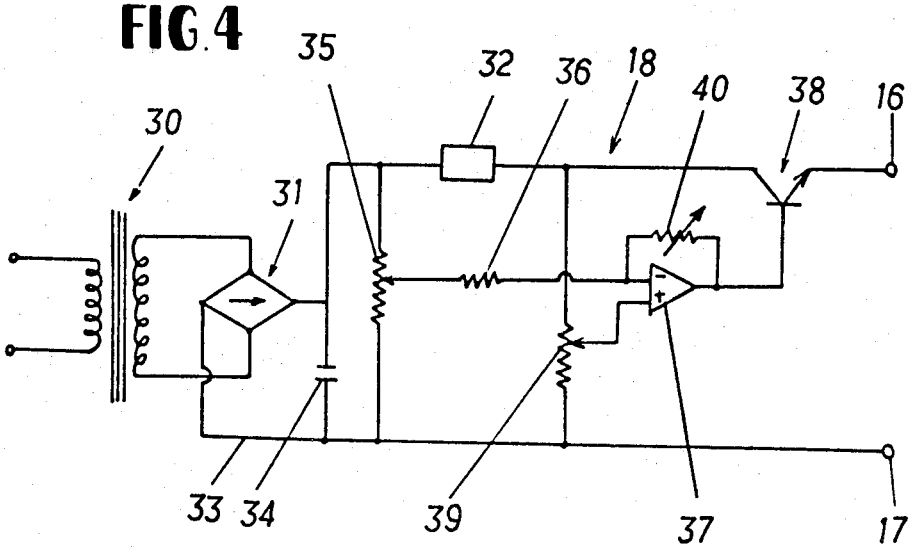

DEVICE FOR CONTROLLING POTENTIAL OF LATENT IMAGE FOR USE IN ELECTROPHOTOGRAPHIC APPARATUS

This is a division of application Ser. No. 859,859, filed Dec. 12, 1977.

BACKGROUND OF THE INVENTION

This invention relates to a method and apparatus of electrophotography of the kind in which charging and original image projection are made to a photosensitive element having a photoconductive layer to form an electrostatic latent image on the surface thereof and the latent image is developed by a developing agent to produce a toner image.

It has generally been required in the method and apparatus of the kind specified that an operation, such as control of the voltage applied to the photosensitive element, adjustment of the position of the charging device or adjustment of the rate of projection of the original image is made to provide a charging voltage suitable for the quality of the photosensitive element used, thereby preventing the formation of a stained background and producing an image having a good tone. When a developing device is used in which there is provided a mixture of toner and carrier, such as iron powder, it is necessary to prevent affixation of the carrier to the photosensitive element to adversely affect the toner image and such an operation as is described above is desirable to minimize this adverse affection. There has, however, been a relatively large dispersion of the quality of the photosensitive elements produced by now and the degree of this dispersion of the quality of the elements is so great as to be incapable of being compensated by the above operation, so that a relatively large amount of the photosensitive elements unfitted to conventional electrophotographic methods and apparatus has to be scrapped.

SUMMARY OF THE INVENTION

It is an object of the present invention to provide a method and apparatus of electrophotography in a simple and convenient form.

It is another object of the present invention to provide a method and apparatus of electrophotography in which the above-described drawbacks are removed.

According to one aspect of the present invention, there is provided a method of electrophotography of the kind comprising steps of preparing a photosensitive element including an electrode layer, a photoconductive layer, a transparent insulating layer and these layers being integrally provided in the order described, applying first charges of one polarity to said insulating layer of said photosensitive element, applying second charges of the opposite polarity to said insulating layer simultaneously with the exposure of said photoconductive layer to a light image, exposing, if desired, said photoconductive layer to a substantially uniform light irradiation, thereby forming an electrostatic latent image on said insulating layer and developing said latent image by a developing agent wherein the application of said first charge to said insulating layer is to serve such that an interface between said photoconductive and insulating layers is substantially filled with trapped charge carriers which have flowed through said photoconductive layer, and before the step of the application of said second charges there is provided a further step of exposing said photoconductive layer to a substantially uniform light irradiation to release a part of said charge carriers from the trapped condition, such that the released charge carriers can flow to said electrode layer during the application of said second charges to said insulating layer to control the potential of said latent image within a range fit for the development of said latent image.

According to another aspect of the present invention, there is provided an apparatus of electrophotography of the kind comprising a photosensitive element movably provided therein and including an electrode layer, a photoconductive layer, a transparent insulating layer and these layers being integrally provided in the order described, a first corona discharging means for applying first charges of one polarity to said insulating layer of said photosensitive element, a second corona discharging means for applying second charges of the opposite polarity and simultaneously projecting a light image to said insulating layer, means for projecting a substantially uniform light irradiation to said charged photoconductive layer, thereby forming an electrostatic latent image on said insulating layer and means for developing said latent image by a developing agent wherein said first corona discharging means is to seve such that an interface between said photoconductive and insulating layers is substantially filled with trapped charge carriers which have flowed through said photoconductive layer, and there is further provided uniform light illumination means provided between said first and second corona discharging means to directing a substantially uniform light to said photoconductive layer to release a part of said charge carriers from the trapped condition, such that the released charge carriers can flow to said electrode layer during the application of said second charges to said insulating layer to control the potential of said latent image within a range fit for the development of said latent image.

BRIEF DESCRIPTION OF THE DRAWINGS

FIG. 2 is an exploded perspective view of a part of the apparatus of FIG. 1;

FIG. 3 is a sectional side view of the part shown in FIG. 2;

FIG. 4 shows an electric circuit which can be incorporated into the apparatus of FIG. 1;

DESCRIPTION OF THE PREFERRED EMBODIMENTS

Figure 1:
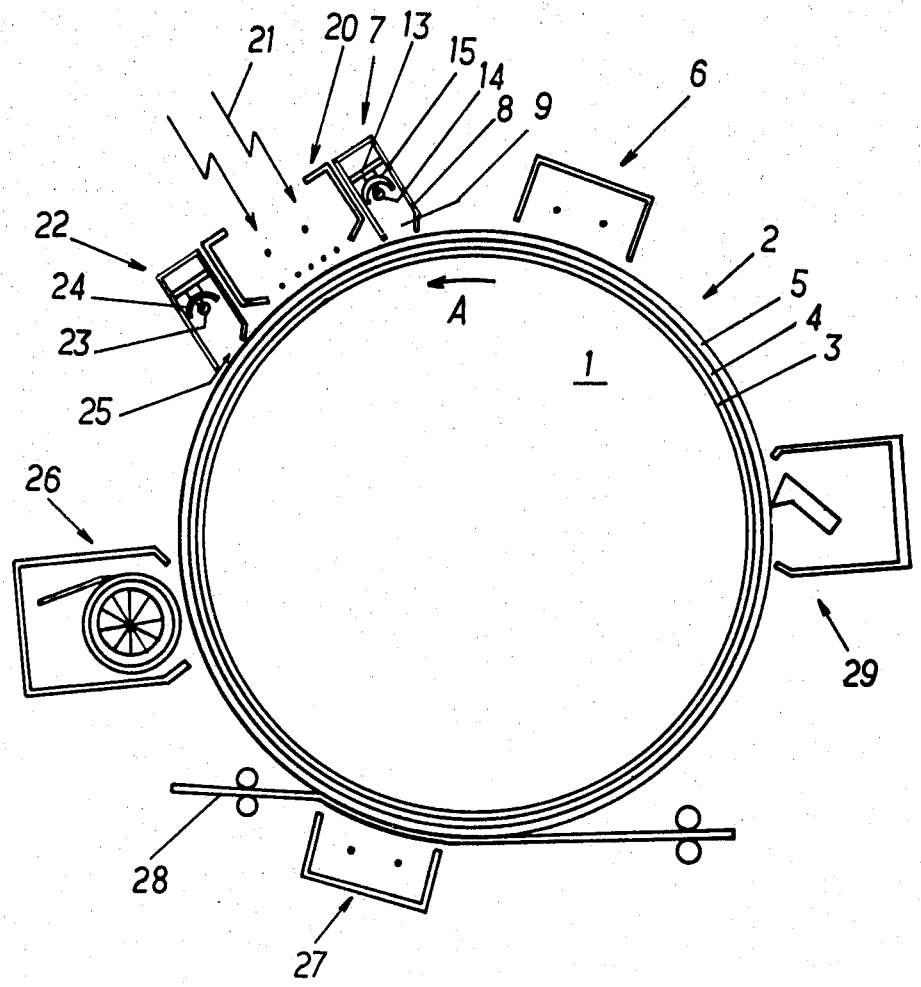
FIG. 1 is a diagrammatic side representation of an embodiment of an apparatus of electrophotography in accordance with the present invention.

The apparatus of electrophotography shown in FIG. 1 is provided therein with a cylindrical drum 1 rotatable at a predetermined speed in a direction of an arrow A, and affixed to an outer periphery of the drum 1 is a photosensitive element 2 which, in this embodiment, includes an electrode layer 3 made of a thin plate of a metal, such as aluminium, a photoconductive layer 4 made of a suitable inorganic or organic semiconductive material by coating or vapor deposition, an insulating layer 5 made of a transparent synthetic resin film and these layers being integrally provided in the order mentioned above to form a three-layer construction.

Disposed adjacent to the outer periphery of the element 2 is a first corona discharger 6 which is secured to a fixed portion of the apparatus to extend axially of the drum 1. As the drum 1 rotates, the discharger 6 acts to cause a substantially uniform deposition of first charges of an appropriate polarity on the surface of the insulating layer 5 of the element 2. At this time, charge carriers existing in the photoconductive layer 4 and having a polarity opposite to that of said first charges are moved to and in the vicinity of the interface between the photoconductive layer 4 and the insulating layer 5 and, at the same time, similar charge carriers are injected from the electrode layer 3 into the photoconductive layer 4 and moved therethrough towards said interface, a substantial amount of these charge carriers being trapped in and near said interface to fill the latter under the influence of said first charges on the insulating layer. In this case, it is desirable to apply a positive D.C. voltage to the corona discharger 6 when the semiconductor of the layer 4 is of a negative type, and to apply a negative D.C. voltage to the corona discharger 6 when the semiconductor is of a positive type.

The portion of the photosensitive element 2 which has been charged as described above is subject to uniform light illumination from a first uniform light illumination device 7 secured to the fixed portion of the apparatus at a position spaced apart from the corona discharger 6 by an appropriate distance. The device 7 includes an elongated casing 8 having a generally C-shaped configulation in section as shown in FIGS. 2 and 3, the casing being disposed such that an opening 9 thereof formed in a lower portion is positioned adjacent to the surface of the element 2 to be open along a generatrix of the latter. One end wall of the casing 8 is arranged by an end plate 10 hinged on an upper end of the casing. Opposite side walls of the casing 8 are formed in their inner surfaces with longitudinal grooves 11 and 12 by which a printed circuit board 13 is supported at its opposite sides to extend longitudinally within the casing 8. The board 13 is longitudinally slidable relative to the casing 8 to disengage therefrom while the end plate 10 is held in its upward position. Fixed to the undersurface of the board 13 is a plurality of lamps 14 which are longitudinally located at a substantially equal space and there is also provided a part-cylindrical reflector 15 for downwardly directing light from the lamps 14, the arrangement being such that such an area of the element 2 as is placed just under the opening 9 is subjected to substantially uniform exposure to the light. The lamps 14 are electrically connected through the circuit on the board 13 to output ends 16 and 17 of a voltage regulating device 18 to irradiate a controlled amount of light to the photosensitive element. With this arrangement, a part of the charge carriers which have been restrained or trapped by the action of the corona discharger 6 in and near the interface between the photoconductive layer 4 and the insulating layer 5 of the element 2 is released from the trapped condition.

The area of the element 2 which has been subjected to the light irradiation from the lamps 14 when passing under the device 7 is then subjected to the corona discharge from a second corona discharger 20 and simultaneously to the original image projection. The corona discharger 20 is secured to the fixed portion of the apparatus to extend axially in close contact with the device 7, and in this embodiment a D.C. voltage having the opposite polarity to that of the voltage applied to the first corona discharger 6, or an A.C. voltage is applied to the second corona discharger 20 to deposit second charges to such an opposite polarity on the area of the element thereunder. Under the influence of the second charges, a substantial amount of the charge carriers in or near said interface released from the trapped condition under the action of the first uniform light illumination device 7 (sometimes referred to herein as a "further" uniform light projecting means) is moved to the electrode layer 3 and accordingly the amount of the first charges on the surface of the element is reduced by the second charges such that the surface potential on the insulating layer 5 of the element is totally and substantially uniformly reduced to an intended value. At the same time, the element 2 is subjected to the original image irradiation. The second corona discharger 20 is optically open at its upper portion and thus the original light image (shown at 21 in FIG. 1) is irradiated therethrough to an area of the element 2 under the discharger 20. In the area of the element 2 corresponding to the light portion of the light image, therefore, a substantial amount of the charge carriers trapped in the interface between the layers 4 and 5 is released to move to the electrode layer 3, whereas in the area of the element 2 corresponding to the dark portion of the light image the charge carriers other than those released from the trapped condition to move to the layer 3 remain trapped in or near said interface.

The area of the element 2 which has been subjected to such an action as is described above is then subjected to uniform light illumination from a second uniform light illumination device 22. The device 22 is of a similar construction to that of the device 7 and is provided on an opposite side of the second corona discharger 20 to the device 7. The device 22 also includes therein a plurality of lamps 23, a part-cylindrical reflector 24 and these being arranged such that a predetermined amount of light is substantially uniformly projected to the area of the element 2 thereunder through an opening 25 formed in a lower portion of the device 22 adjacent to the element. Thus, the substantial amount of the charge carriers trapped in said interface within the area of the element corresponding to the dark portion of the light image is rapidly released to move to the electrode layer 3. In this manner, an electrostatic latent image corresponding to the original image is formed on the surface of the insulating layer 5 of the element 2, the latent image having a predetermined potential difference between the portions of the latent image corresponding to the light and dark portions, respectively, of the original image.

The area of the photosensitive element 2 on which the above-described latent image is formed is angularly moved to a developing device 26 wherein the latent image is developed. The device 26 may be of a known dry developer type, such as a cascade or magnetic roller type, using a mixture containing toner powder and carrier particles, such as iron particles, at a predetermined ratio, or of a known liquid developer type, and the toner is electrostatically affixed to the area of the element to develop the latent image.

The toner image formed on the surface of the element in such a manner as is described above is transferred by an image transfer device 27 to a receptor sheet 28 fed in timed relationship with the movement of the element. The toner image transferred to the sheet is fixed thereto by a fixing device (not shown) to produce a permanent picture when it passes through the fixing device. On the other hand, the element 2, after passing through the device 27, is subjected to a cleaning device 29 for removing the residual toner from the element, and then moved to the corona discharger 6 for repeated use.

When the potential of such a portion of the latent image as is corresponding to the dark portion of the light image entering into the above-described type of the developing device (hereinafter referred to as dark portion of the latent image) is higher than a predetermined value, a certain amount of carriers is affixed to the dark portion of the latent image during development to adversely affected the picture developed. When the potential of the dark portion of the latent image is too low, on the contrary, the intensity of the latent image is insufficient to produce a clear picture. The optimum value of the potential of the dark portion of the latent image considered from this point of view is determined by the parameters, such as the type and characteristics of the photosensitive element to be used, the kind and size of the carrier particles used in the developing device and the mixing ratio of the carrier and toner therefor, and thus when these parameters are determined the parts of the electrophotographic apparatus are designed to provide a suitable potential of the dark portion of the latent image therefor. In use, however, variation in the voltage of the supply source will result in variation in the quantity of light for projecting the original image to the photosensitive element causing the adverse effects as described above. In addition, the photosensitive elements produced as products have a relatively large dispersion in their quality and thus there has been a problem that a relatively large number of elements does not suit to the setting conditions as described above and is incapable for use. This problem will, however, be readily solved by the present invention in such a manner as will be described hereunder.

The lamps 14 of the first uniform light illumination device 7 are connected in parallel with each other through the circuit board 13 to the output ends 16 and 17 of the voltage regulating device 18 of FIG. 4. The device 18 includes a transformer 30 of which a primary winding is connected to an alternating current power source and a secondary winding also to input ends of rectifier 31. One of output ends of the rectifier 31 is connected to an input end of a constant-voltage generating devide 32 and the other output end is connected through a line 33 to the output end 17 of the device 18. Connected in parallel between the output ends of the rectifier 31 are a condenser 34 and a resistor 35 having a movable intermediate contact which is connected through a resistor 36 to an inverting input end of an operational amplifier 37. An output end of the device 32 is connected to a collector of a transistor 38 and also to the line 33 through a resistor 39 which has a movable intermediate contact connected to a non-inverting input end of the amplifier 37. An output end of the amplifier 37 is connected to a base of the transistor 38 and also to the inverting input end of the amplifier 37 through a variable resistor 40. An emitter of the transistor 38 is connected to the output end 16 of the device 18.

The above-described circuit satisfies the following equation:

$$E_3 = E_2 + C(E_2 - E_1)$$

wherein C is a ratio of values of the resistance of the resistors 40 and 36 and $E_1$, $E_2$ and $E_3$ are the voltages at the inverting and non-inverting input ends and at the output end, respectively, of the operational amplifier 37. Therefore, the voltage $E_3$ of the output end of the amplifier can be determined by pre-adjusting the position of the intermediate contact of the resistor 39 to set the voltage $E_2$ of the non-inverting input end to an appropriate value and pre-adjusting the variable resistor 40 to control variation in the voltage $E_3$ relative to the voltage $E_1$ of the inverting input end, that is to the variation in voltage of the power source. Thus, when the voltage of the power source decreases the voltage $E_3$ is increased and when the voltage of the power source increases the voltage $E_3$ is decreased. Therefore, the voltage across the output ends 16 and 17 amplified by the transistor 38 and thus the voltage applied to the lamps 14 of the device 7 is varied in accordance with the variation in the voltage $E_3$ such that when the voltage of the power source decreases the quantity of light projected from the lamps 14 to the element 2 is increased and when the voltage of the power source increases the quantity of that light is decreased.

In case that the present invention is applied to an ordinary electrophotographic apparatus, the power consumption of the device 7 is at the largest about 1 to 3 watts for accomplishing its purposes and effects. Therefore, the constant-voltage generating device 32 can also be used as a power source of a control device for the other portion of the apparatus.

The original image irradiation device requires the electric power of about 300 watts to 4 kilo-watts, and the ordinary electrophotographic apparatus has no device for controlling the voltage applied to the original image irradiation device to a desired value. Therefore, the quantity of light of the original image irradiated to the element 2 is decreased when the voltage of the voltage of the power source decreases, and is increased when the voltage of the power source increases. When the voltage of the power source is, in use, varied, therefore, there will be caused a risk that the potential of the electrostatic latent image formed on the surface of the element 2 is deviated from the range suitable for the predetermined optimum image development, such that not only the tone but also the carrier is affixed to the surface of the element to degrade the image quality. The voltage regulating device 18 for the first uniform light illumination device 7 is to remove such a risk and automatically control the quantity of the uniform light projected from the device 7 to the element such that even when the voltage of the power source is varied an electrostatic latent image having a potential suitable for the optimum image development can be formed on the element to produce a good visible image.

For bringing forth the effect to the highest extent, it is necessary to make the closest possible disposition of the device 7 to the forward end of the second corona discharger 20.

Figure 5:
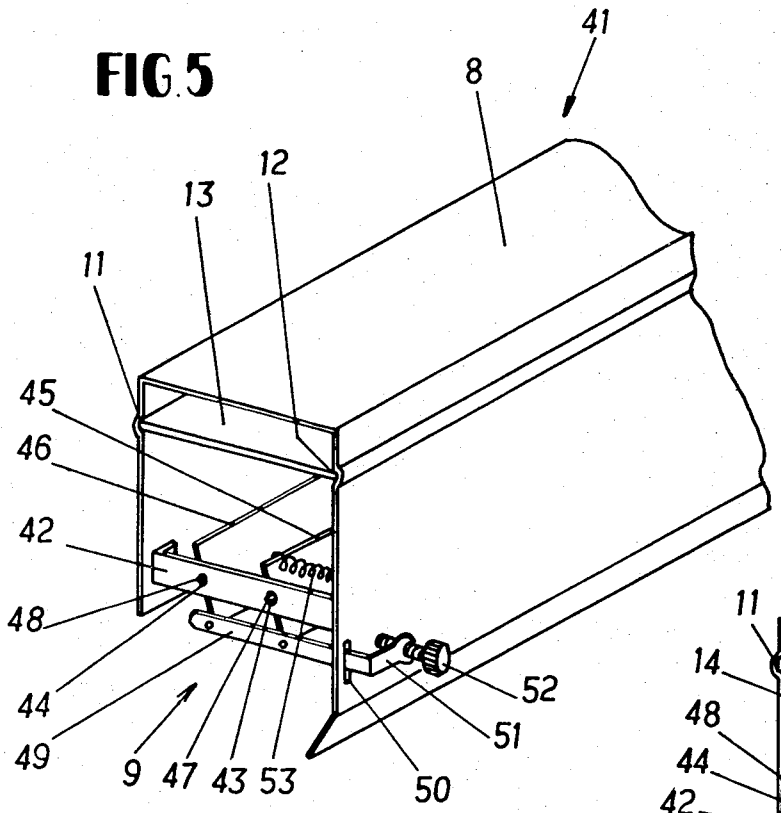
FIG. 5 is a perspective view partly broken away of a modification of the part shown in FIG. 2.
Figure 6:
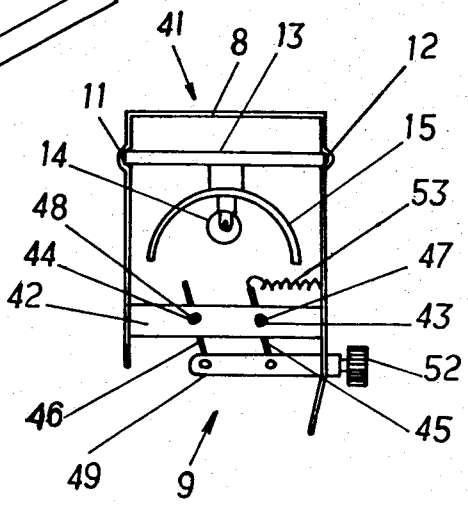
FIG. 6 is a sectional side view of the part of FIG. 5.

FIGS. 5 and 6 show another embodiment of the first uniform light illumination device and similar parts to those of the device of FIGS. 1 to 3 are referred to by the same characters. The first uniform light illumination device 41 is provided with a pair of mumbers 42 (only one of them being shown) which are fixed to inner portions of side walls at opposite ends, respectively, of the casing 8. Each of the members 42 is formed with a pair of spaced holes 43, 44, the holes 43 of the two members 42 being aligned with each other longitudinally of the device and the holes 44 being similarly aligned with each other. Provided between the lamps 14 and the opening 9 is a pair of longitudinally extending plate-like members 45 and 46 each of which is formed at its opposite ends with a pair of integral projections 47 (only one of them being shown) for extending through the holes 43 of the members 42 thereby rotatably supporting the member 45. Similarly, the member 46 is provided at its opposite ends with a pair of integral projections 48 (only one of them being also shown) which extend through the holes 44 of the members 42 to rotatably support the member 46. The plate-like members 45, 46 are pivotally connected at a lower portion of one end to a member 49 which extends laterally through a hole 50 formed in an adjacent side wall of the casing to protrude the exterior, the protruded end of the member 49 being formed with a bent portion 51 which is provided with a threaded hole for a screw 52. The plate-like member 45 is connected at its upper portion of one end by an end of a tension spring 53 of which the other end is, in turn, fixed to the side wall of the casing 8. The spring 53 serves to bias the member 45 in a clockwise direction as viewed in FIG. 6 until the end of the screws 52 abuts against the side wall of the casing 8 to retain the members 45, 46 in the position shown, such that the light from the lamps 14 can pass through the space defined by the members 45, 46. With this arrangement, the quantity of light projected to the element can be controlled by rotating the screw 52 to adjust the angular position of the members 45, 46. This control of the quantity of the light corresponds to that achieved by adjusting the position of the intermediate contact of the resistor 39 in the first-mentioned embodiment. Therefore, in case that the circuit of FIG. 4 is used with the device 41, the resistor 39 may be substituted by a resistor having a fixed intermediate point.

In the present invention, it is preferable to make the uniform light illumination by the first uniform light illumination device to the photosensitive element just before the light image projection thereto, and it is further effective that lamps emitting light including infrared rays are used as lamps 14 sufficiently to penetrate the light into the interior of the photoconductive layer of the element.

With the arrangement described above, the present invention is advantageous in that the potential level of the electrostatic latent image formed on the element can easily be adjusted in accordance with the characteristics of the element and the developing condition of the developing device to produce good developed images and in that when the voltage of the power source varies in use, the potential level of the latent image on the element can automatically be controlled to a predetermined value to constantly produce good developed images. It will further be understood that the present invention can be applied to an electrophotographic system without the provision of the second uniform light illumination and so-called Carlson system irrespective of the types of the element and the developing system incorporated therein.

A practical example of the present invention will next be described.

Example:

The apparatus shown in FIG. 1 was used in a room of which the temperature was 22° C. and the relative humidity was 70%. In this apparatus, the distance between the first and second corona dischargers 6 and 20 was about 60 mm and the first uniform light illumination device 7 was disposed close to the second corona discharger 20 and the distance therebetween was about 2 mm. The device 7 was provided with tungsten lamps as lamps 14 and which lamps were connected to the constant voltage generating device through a variable resistor set to adjust the applied voltage to the lamps at 60 volts such that the quantity of the uniform light on the element was about 6 micro-joules. The element comprised an electrode layer made of an aluminium foil, a photoconductive layer of about 60 microns in thickness in which a copper-activated cadmium sulfide powder was bonded by an adhesive agent, an insulating layer made of a transparent polyester film of 25 microns in thickness and these layers being integrally bonded in the order mentioned above. The element was mounted on the drum 1 such that the electrode layer of the element was in close contact with the periphery of the drum. The drum was then rotated in the direction of the arrow A of FIG. 1 so that the peripheral speed of the element was 100 mm/sec., while the D.C. voltage of about +6000 volts was applied to the first corona discharger to uniformly deposit positive charges on the surface of the element. The above-described quantity of the uniform light was then projected by the first uniform light illumination device 7 to the element. The element was then subjected to the negative corona discharge from the second corona discharger 20 to which the D.C. voltage of about −6000 volts was applied and simultaneously subjected to an original light image projection through the device 20, the quantity of the light portion of the original image being 1.1 micro-joules when measured on the surface of the element. The element was then subjected to the uniform light illumination (its quantity being 24 micro-joules when measured on the surface of the element) by the second uniform light illumination device 22 to form an electrostatic latent image corresponding to the original image on the insulating layer of the element. The surface potentials of this latent image were about +400 volts at its dark portion and about −60 volts at its light portion. The latent image was then developed by the developing device 26. This device was of a rotary sleeve and magnet type using a dry developing powder, the peripheral speed of the sleeve being about 370 mm/sec., the magnetic flux density at the surface of the sleeve being 900 G, and the developing agent being a mixture of 10 weight parts of the toner having a mean particle size of 10 microns and 100 weight parts of the iron particles having the particle size of about 350 to about 500 meshes. As a result, it was observed that the development of the latent image was made only by the toner and no iron particle was attached to it. This toner image was then transferred to a plain paper and a clear and good picture was produced.

Figure 7:
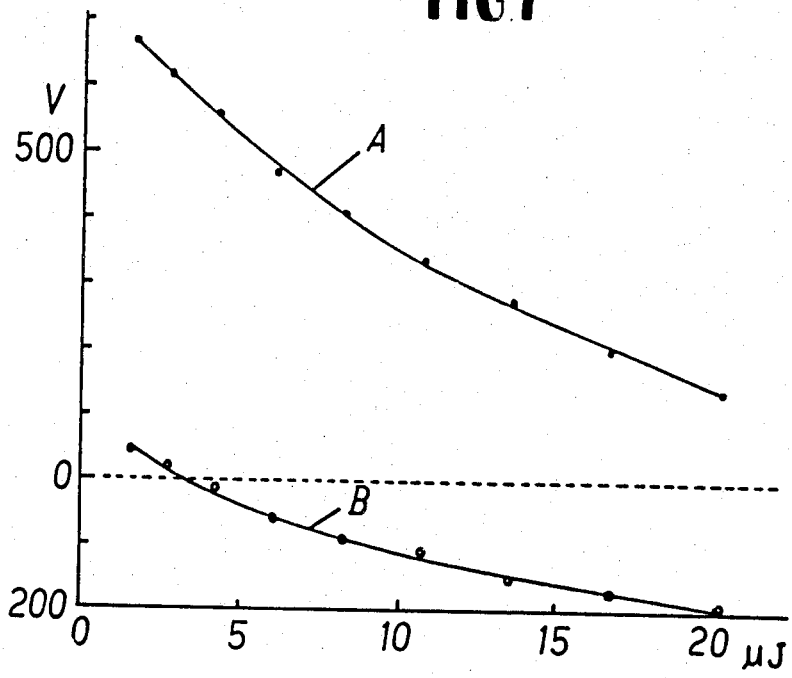
FIGS. 7 and 8 are graphs showing the results of measurements in an example of the present invention.
Figure 8:
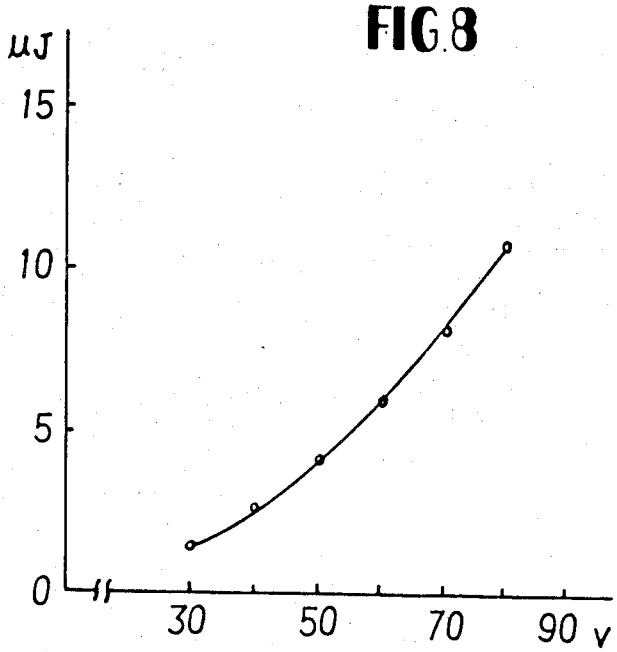

Next, latent images were formed on the photosensitive element under the condition that the quantity of the uniform light projected by the first uniform light illumination device 7 to the element was varied and the other parameters were maintained unchanged, and the potentials at the dark and light portions of the latent image were measured by a surface potential meter. The result of this measurement is shown in FIG. 7. Curves A and B in FIG. 7 show potentials at the dark and light portions, respectively, of the latent image in accordance with variation in the quantity of said uniform light reaching the element, and the dots shown are the observations. FIG. 8 shows the relation between the voltage applied to the lamps 14 and the quantity of the uniform light reaching the element in this case.

Those latent images were then developed by the above-mentioned developing device. Consequently, when the potential at the dark portion of the latent image was lower than 500 volts, no iron particle was attached to the toner image formed on the element, but when said potential was higher than 500 volts the developed image on the element was formed while iron particles were attached to the area corresponding to the dark portion of the latent image to degrade the image quality.

The lamps 14 of the first uniform light illumination device 7 were then connected to the voltage regulating device 18 of FIG. 4 in such a manner as described hereinbefore and adjustment was made such that the dark and light portions of the latent image were +400 volts and −600 volts, respectively, when the input voltage of the power source of the electrophotographic apparatus was a rated voltage (100 volts). While the input voltage of said power source was varied within the range of ±15% from the rated voltage, images were produced in such a manner as described above. As a result, when the variation in the input voltage of the power source was within said range, no carrier particle was attached to the developed images and a good image quality was obtained.

What is claimed is:

1. In an apparatus for electrophotography of the kind comprising: a photosensitive element on a movable drum and including an electrode layer, a photoconductive layer and a transparent insulating layer, these layers being integrally provided in the order described; a first corona discharging means for applying first charges of one polarity to said insulating layer of said photosensitive element under the condition that an interface between said photoconductive and insulating layers is substantially filled with trapped charge carriers which have flowed through said photoconductive layer; a second corona discharging means for applying second charges of a polarity opposite to said one polarity and simultaneously projecting a light image to said element; and means for projecting a substantially uniform light to said element; the recited means thereby completing formation of an electrostatic latent image on said insulating layer; and means for developing said latent image by use of a developing agent; the improvement comprising:

further uniform light projecting means in close contact with said second corona discharging means and operative just before said corona discharging means to release some of said charge carriers from the trapped condition, such that the released charge carriers can flow to said electrode layer during the application of said second charge to said insulating layer to control the potential of said latent image.

2. An apparatus according to claim 1 wherein said photoconductive layer of said element includes copper-activated cadmium sulfide and said first corona discharging means is energized by direct current positive voltage to deposit first charges of the positive polarity and said further uniform light projecting means includes a lamp for emitting light containing infrared rays.

3. An apparatus according to claim 1 wherein said further uniform light projecting means includes a lamp for emitting light to said photoconductive layer of said element and control means for controlling the quantity of the light reaching said photoconductive layer, thereby causing the flow of an appropriate amount of said released charge carriers to said electrode layer of said element to control the surface potential of said insulating layer of said element to a desired value.

4. An apparatus according to claim 3 wherein said control means comprise a voltage regulating device through which said lamp is connected to an electric power source of the apparatus to preset the voltage applied to said lamp to predetermined level, thereby adjusting the quantity of the light emitting therefrom.

5. An apparatus according to claim 4 wherein said voltage regulating device includes an operational amplifier acting such that when the voltage of said power source is lowered the voltage applied to said lamp is increased from said level to cause increase in the quantity of the light emitting therefrom and when the voltage of said power source is increased the voltage applied to said lamp is decreased from said level to cause decrease in the quantity of the light.

6. An apparatus according to claim 3 wherein said control means comprise a fixed casing open to direct the light from said lamp to said photoconductive layer of said element and a plate-like member pivotally mounted on said casing to control the quantity of said light.

7. In an apparatus for electophotography of the kind comprising: a photosensitive element on a movable drum and including an electrode layer, a photoconductive layer and a transparent insulating layer, these layers being integrally provided in the order described; a first corona discharging means for applying first charges of one polarity to said insulating layer of said photosensitive element under the condition that an interface between said photoconductive and insulating layers is substantially filled with trapped charge carriers which have flowed through said photoconductive layer; a second corona discharging means for applying second charges of a polarity opposite to said one polarity and simultaneously projecting a light image to said element; and means for projecting a substantially uniform light to said element; the recited means thereby completing formation of an electrostatic latent image on said insulating layer; and means for developing said latent image by use of a developing agent; the improvement comprising:

further uniform light projecting means operative just before said second corona discharging means to release some of said charge carriers from the trapped condition, such that the released charge carriers can flow to said electrode layer during the application of said second charge to said insulating layer to control the potential of said latent image, said further uniform light projecting means including a lamp for emitting light to said photoconductive layer of said element and control means for controlling the quantity of the light reaching said photoconductive layer, thereby causing the flow of an appropriate amount of said released charge carriers to said electrode layer of said element to control the surface potential of said insulating layer of said element to a desired value.

8. An apparatus according to claim 7 wherein said control means comprise a voltage regulating device through which said lamp is connected to an electric power source of the apparatus to preset the voltage applied to said lamp to predetermined level, thereby adjusting the quantity of the light emitting therefrom.

9. An apparatus according to claim 8 wherein said voltage regulating device includes an operational amplifier acting such that when the voltage of said power source is lowered the voltage applied to said lamp is increased from said level to cause increase in the quantity of the light emitting therefrom and when the voltage of said power source is increased the voltage applied to said lamp is decreased from said level to cause decrease in the quantity of the light.

10. An apparatus according to claim 7 wherein said control means comprise a fixed casing open to direct the light from said lamp to said photoconductive layer of said element and plate-like member pivotally mounted on said casing to control the quantity of said light.

11. In an apparatus for electrophotography of the kind comprising: a photosensitive element on a movable drum and including an electrode layer, a photoconductive layer and a transparent insulating layer, these layers being integrally provided in the order described; a first corona discharging means for applying first charges of one polarity to said insulating layer of said photosensitive element under the condition that an interface between said photoconductive and insulating layers is substantially filled with trapped charge carriers which have flowed through said photoconductive layer; a second corona discharging means for applying second charges of a polarity opposite to said one polarity and simultaneously projecting a light image to said element; and means for projecting a substantially uniform light to said element; the recited means thereby completing formation of an electrostatic latent image on said insulating layer; and means for developing said latent image by use of a developing agent; the improvement comprising:

further uniform light projecting means operative from the insulating layer side of said photosensitive element and just before said second corona discharging means to release some of said charge carriers from the trapped condition, such that the released charge carriers can flow to said electrode layer during the application of said second charge to said insulating layer to control the potential of said latent image.

* * * * *